US005090825A

United States Patent [19]

Merriman, Jr. et al.

[11] Patent Number: 5,090,825

[45] Date of Patent: Feb. 25, 1992

[54] STABILIZER FOR A FLOATING PLATEN

[75] Inventors: Richard A. Merriman, Jr., Dayton; Howard B. Mayfield, Miamisburg, both of Ohio

[73] Assignee: NCR Corporation, Dayton, Ohio

[21] Appl. No.: 672,793

[22] Filed: Mar. 21, 1991

[51] Int. Cl.[5] ..... B41J 11/20

[52] U.S. Cl. ..... 400/58; 400/649; 400/656

[58] Field of Search ..... 400/56, 57, 58, 59, 400/649, 656

[56] References Cited

U.S. PATENT DOCUMENTS

| | | | |
|---|---|---|---|
| 4,227,819 | 10/1980 | Manriquez | 400/656 |
| 4,420,269 | 12/1983 | Acuermann et al. | 400/56 |
| 4,462,702 | 7/1984 | Fritz et al. | 400/656 |
| 4,836,696 | 6/1989 | Okumura et al. | 400/656 |
| 4,957,382 | 9/1990 | Delaney et al. | 400/656 |

FOREIGN PATENT DOCUMENTS

| | | | |
|---|---|---|---|
| 0011377 | 1/1985 | Japan | 400/656 |
| 0019567 | 1/1985 | Japan | 400/656 |
| 2175854 | 12/1986 | United Kingdom | 400/656 |

*Primary Examiner*—Eugene H. Eickholt
*Attorney, Agent, or Firm*—Elmer Wargo

[57] ABSTRACT

An apparatus for use with a print head which is used in conjunction with a floating platen. The print head is mounted on a carriage which has a forms compensation member secured to it to contact the top surface of a document to be printed upon. The forms compensation member causes the print surface of the platen to tilt somewhat causing ink smears or uneven printing by the print head. A stabilizer is used to offset the tilting caused by the forms compensation member to thereby maintain the printing surface of the platen in parallel relationship with print face of the print head, which in the embodiment described, is a wire matrix printer. The stabilizer includes first and second leaf springs which are secured to the platen and cooperate with a channel in which the platen is mounted.

8 Claims, 4 Drawing Sheets

STABILIZER FOR A FLOATING PLATEN

BACKGROUND OF THE INVENTION (1) Field Of The Invention

This invention relates to a stabilizer for a floating platen used, for example, in a wire matrix printer.

(2) Background Information

In certain printers which are used in financial systems, for example, it is necessary for the printer to be able to print on media (a single sheet of paper or a passbook containing several sheets) having varying thicknesses. When such a requirement is made in a wire matrix printer environment, it is generally necessary that a forms compensation member be used. The forms compensation member is positioned close to the print head associated with the printer, and it is used to maintain a predetermined distance between the face of the print head and the top surface of the document to be printed upon. The platen associated with the printer is resiliently biased towards the face of the print head, with the top surface of the platen being spaced from the face of the print head by a distance which depends upon the thickness of the document. However, the forms compensation member keeps the face of the print head a predetermined distance from the top surface of the document being printed upon. Because the platen is not fixed relative to the face of the printer, it is referred to as a "floating platen".

One of the problems with a floating platen of the type mentioned above is that the top surface of the platen tends to tilt with respect to the face of the print head. This tilting occurs because the print head is located near the center of the platen and the associated forms compensation member is located close to the print head but to one side thereof. Because the forms compensation member applies its force near an edge of the platen, it causes the platen to tilt. When this occurs, the top surface of the platen is not parallel to the face of the print head; consequently, as the print head moves along the length of the platen in printing relationship therewith, it tends to produce defective printing by smudging the printing or causing a smudge line along the length of the platen. Generally an ink ribbon is located between the face of the printer and the top surface of the document to be printed upon.

SUMMARY OF THE INVENTION

An object of this invention is to provide an apparatus which obviates the problem mentioned in the previous paragraph.

Another object of this invention is provide an apparatus of the type mentioned which is low in cost and easy to manufacture.

In a preferred embodiment of this invention there is provided an apparatus comprising:

a print head having a printing face and an associated forms compensation member; and a floating platen comprising:

a channel having first and second side walls and a bottom;

a platen having a printing surface, with said platen located in said channel;

resilient means biasing the platen away from the bottom of the channel towards said forms compensation member; and a stabilizer means secured to said platen and cooperating with one of said first and second side walls to maintain said printing surface in parallel relationship with said printing face.

In another aspect of the invention, there is provided a platen for use with an apparatus having:

a print head having a printing face and an associated forms compensation member; and a channel having first and second side walls and a bottom;

said platen being quadrilaterally-shaped in cross section and comprising:

a printing surface, an opposed bottom surface, and first and second side surfaces;

resilient means located on said bottom surface for urging said platen towards said print head when said platen is installed in said channel; and first and second leaf springs which are spaced apart along said platen, with each one of said first and second leaf springs having a first end and a second end, with said first ends secured to said platen, and with said second ends contacting said second side wall when said platen is installed in said channel.

The above advantages, and others, will be more readily understood in connection with the following specification, claims, and drawing.

DESCRIPTION OF THE PREFERRED EMBODIMENT

Figure 1:
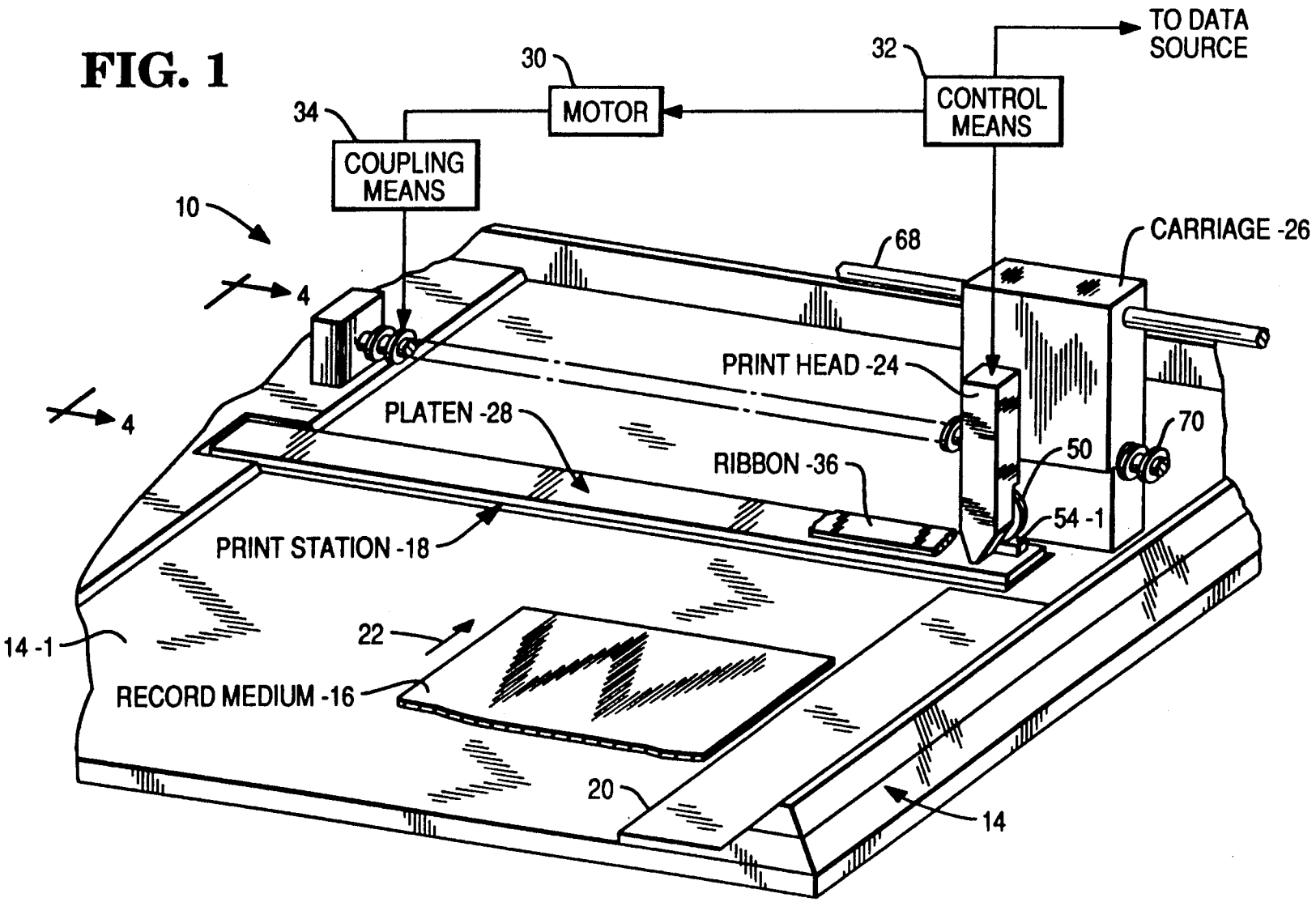
FIG. 1 is a general isometric view showing a printer in which a preferred embodiment of the apparatus of this invention may be incorporated.

FIG. 1 is a general isometric view, shown partially in diagrammatic form, of a printer 10 in which the apparatus 12 (FIG. 5) of this invention may be used. The printer 10 includes a support means 14 for guiding a record medium 16 to be printed upon to a print station 18. The record medium 16 can vary in thickness from a single sheet to a "pass book" used in financial institutions, for example. A record medium 16 to be printed upon is positioned on a top surface 14-1 of the support means 14, and a side wall 20 is used to guide the record medium 16 in a feeding direction (shown by arrow 22) to the print station 18. The printer 10 also includes a print head 24 and a carriage 26 upon which the print head 24 is mounted for printing along the length of a platen 28. The carriage 26 is moved bi-directionally along the length of the platen 28 by a bi-directional motor 30 which is under the control of a conventional control means 34. A conventional coupling means 34 is used to couple the motor 30 to the carriage 26; because this aspect is not important to an understanding of the invention, it need not be discussed in any further detail. A ribbon 36 is positioned between the print head 24 and the record medium 16 at the print station 18.

Figure 3:
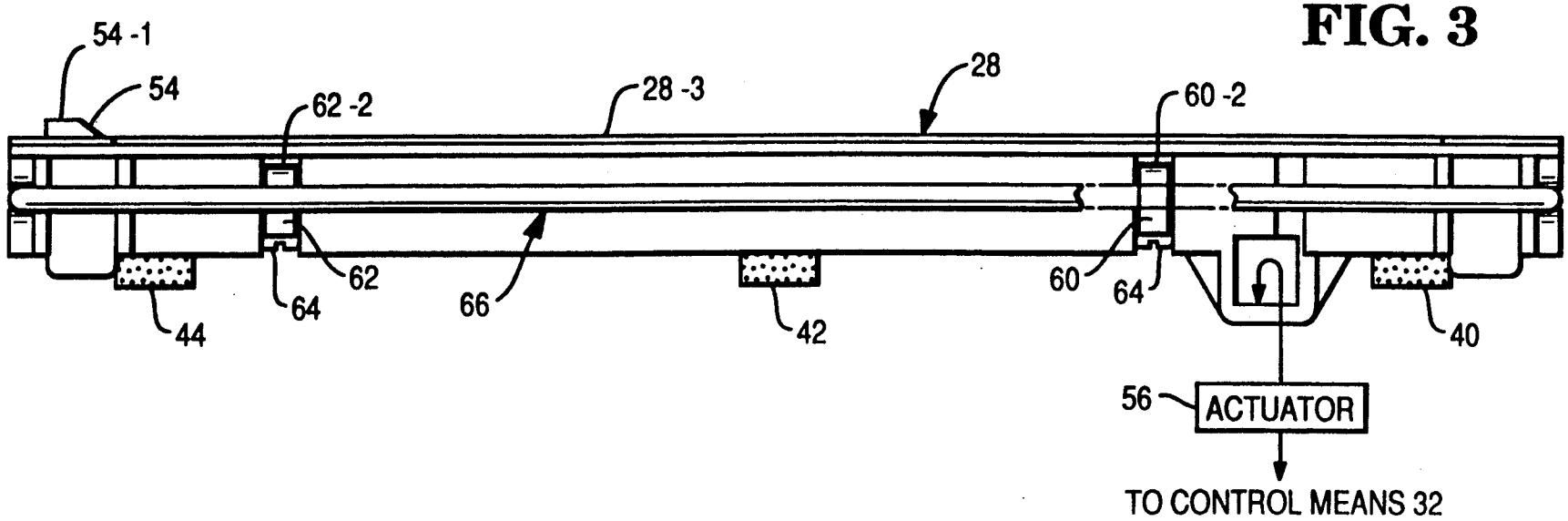
FIG. 3 is a side view, in elevation, of the platen shown in FIG. 2, with the view taken from the direction of arrow A shown in FIG. 2.

The apparatus 12 includes the platen 28 which is referred to as a "floating" platen. The platen 28 is located in a channel 38 shown best in FIGS. 4 and 5. The channel 38 is generally "U"-shaped in cross section and has a first wall 38-1, a second wall 38-2, and a bottom 38-3 as shown. The platen 28 is biased towards the print head 24 by resilient means shown as foam rubber members 40, 42, and 44 (FIG. 3). The platen 28 is quadrilaterally-shaped in cross section and has a first side surface 28-1, a second side surface 28-2, a printing surface 28-3, and an opposed bottom surface 28-4. The platen 28 has a metal core 28-5 (FIG. 5) which is surrounded by a layer of plastic material 28-6.

Figure 4:
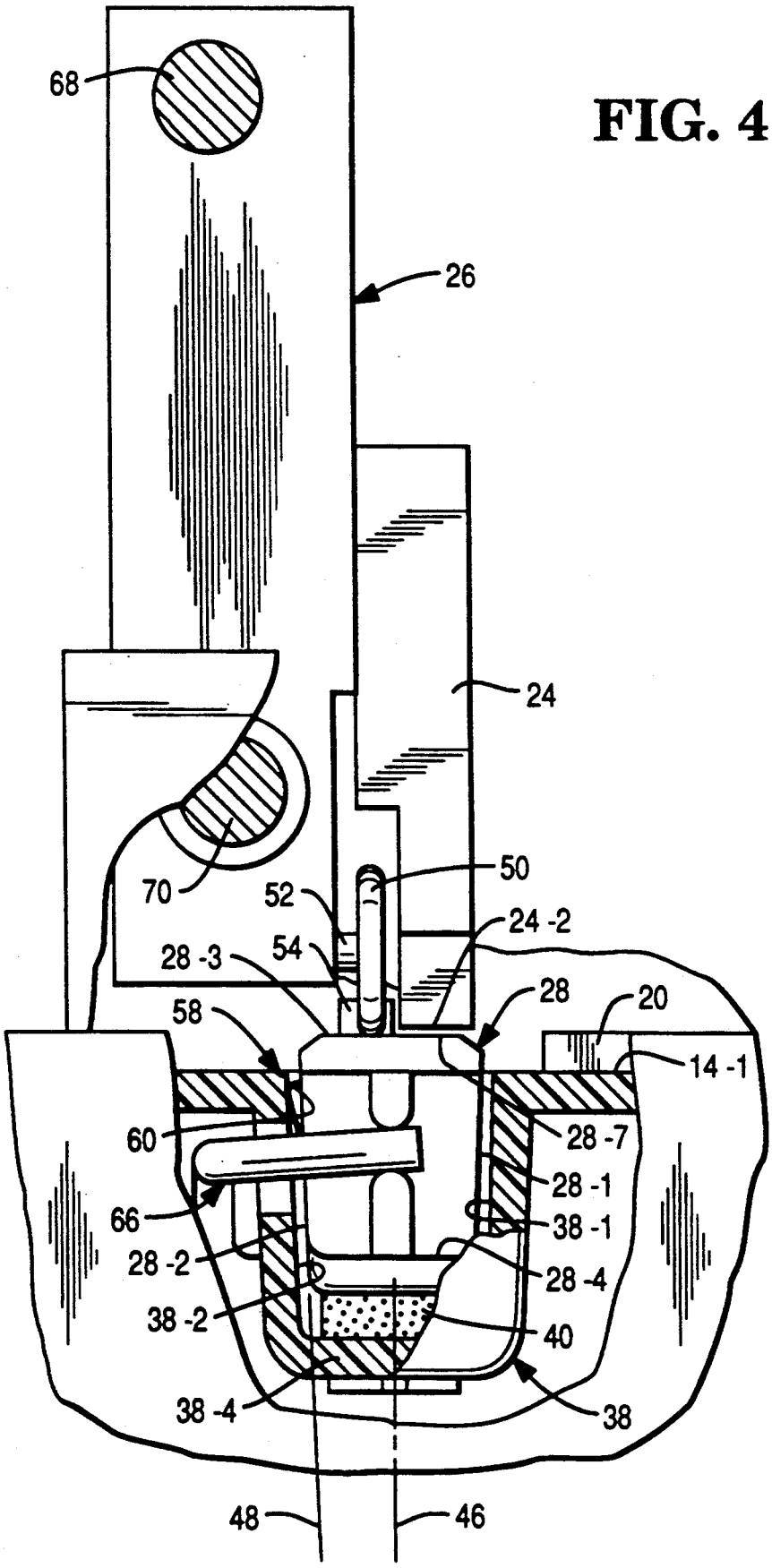
FIG. 4 is a cross-sectional view, taken along the line 4—4 of FIG. 1 to show additional details of the apparatus shown in FIG. 1.

When the platen 28 is manufactured, there is a small draft angle provided in the mold which is utilized to mold a layer of plastic material 28-6 around the metal core 28-5 of the platen 28. As a result, the first and second sides 28-1 and 28-2 are not parallel to each but diverge away from a center line 46 by a draft angle of two degrees (in the embodiment described) as shown by line 48 (FIG. 4). This enables the finished platen 28 to be removed from the mold in which it was manufactured. When the channel 38 is molded, the first and second walls 38-1 and 38-2 similarly diverge away from the center line 46 by a similar draft angle of two degrees to facilitate removing the channel 28 from its associated manufacturing mold.

As alluded to earlier herein, the platen 28 is a floating platen in that it is not fixed relative to the print head 24 (FIG. 4). The particular print head 24 shown is a wire matrix printer, with the print wires 24-1 (FIG. 5) thereof emerging slightly from the printing face 24-2 of the print head 24. For the print head 24 to print properly, it is necessary that the print wires 24-1 and the print face 24-2 be positioned a predetermined distance from the record medium 16 to be printed upon. It is also necessary that the printing surface 28-3 of the platen 28 be maintained parallel to the print face 24-2 of the print head.

Figure 5:
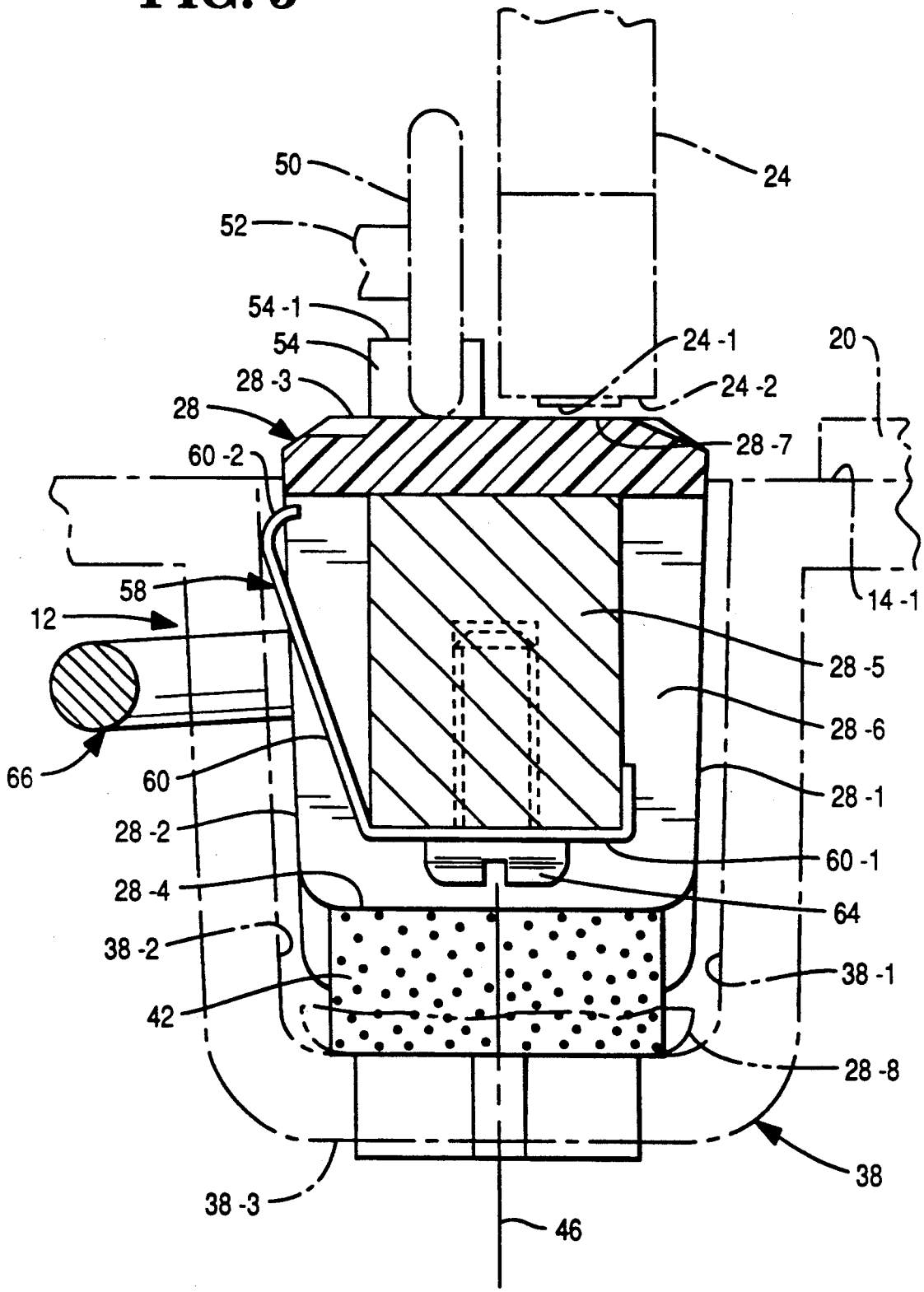
FIG. 5 is an enlarged, cross-sectional view, taken along the line 5—5 of FIG. 2 to show additional details of a stabilizer means used in the apparatus.

Because the printer 10 is designed to print on a thin or thick record medium 16, for example, a forms compensation member, shown in the form of a wheel 50 FIGS. 4 and 5) is used. The wheel 50 is rotatably mounted on a shaft 52 which is secured to the carriage 26. When no record medium 16 is present at the print station 18, the wheel 50 rides on the printing surface 28-3 of the platen 28 as the print head 24 moves along the length of the platen 28. When the print head 24 reaches the right side of the printer 10 (as viewed in FIG. 1) the wheel 50 rides up a ramp 54 to a flat area 54-1 thereon to lower platen 28 so that its printing surface 28-3 is below the top surface 14-1 of the support means 14. An actuator 56, under the control of the control means 32 pulls the platen 28 down or away from the print head 24 so that a record medium can be inserted therebetween. The platen 28 is shown in the lowered position by dashed line 28-8 in FIG. 5.

After insertion of the record medium 16 at the print station 18, the actuator 56 is released, permitting the foam rubber members 40, 42, and 44 to move the platen 28 towards the print head 24. When the print head 24 moves away from the right edge of the printer 10 (as viewed in FIG. 1), the wheel 50 moves off the ramp 54, permitting the wheel 50 to engage the top surface of the record medium 16 to be printed upon. Regardless of the thickness of the record medium 16, the wheel 50 keeps the print face 24-2 of the print head 24 a fixed distance from the top surface of the record medium. Generally, the wheel 50 is located close to the print wires 24-1 of the print head 24 to maintain the fixed distance mentioned in the previous sentence.

As alluded to earlier herein, and as shown best in FIG. 5, the wheel 50 tends to cause the platen 28 to tilt with respect to the centerline 46 as it moves along the length of the platen 28. This is due in part to the looseness in the fit between the channel 38 and the platen 28 as discussed relative to the draft angles for these parts. When this occurs, the tilting causes the right side 28-7 of the platen 28 to move closer to the face 24-2 of the print head 24 than the left side thereof. Normally, this causes a smear or smudge to appear on the record medium 16 near the right side 28-7 of the platen 28 due to the ribbon 36 (not shown in FIG. 5) being squeezed therebetween. This tilting also causes problems with the print wires 24-1 of the print head not attaining sufficient velocity to attain even printing density over the height of the characters being printed.

The apparatus 12 of this invention also includes a stabilizer means 58 which is secured to the platen 28 and cooperates with the second wall 38-2 of the channel 38 to maintain the printing surface 28-3 of the platen 28 in parallel relationship with the print face 24-2 of the platen 24. In the embodiment described, the stabilizer means 58 includes a first leaf spring 60 and a second leaf spring 62, with each of these springs having a first end, like 60-1, which is secured to the platen 28 by a fastener 64. In the embodiment described, the first and second leaf springs 60 and 62 are made of beryllium copper alloy. The free end 60-2 of the first spring 60 is initially biased away from the platen 28, and when it engages the second wall 38-2 of the channel 38, as shown in FIG. 5, it offsets the tilting mentioned; the same is true for the free end 62-2 of the second spring 62. The layer 28-6 of plastic surrounding the metal core 28-5 of the platen 28 is removed in the areas of the first and second leaf springs 60 and 62 to provide a clearance for these springs when the platen 28 is lowered into the channel 28 towards the bottom 38-3 thereof. The clearance also enables the first ends, like 60-1, of the leaf springs 60 and 62 to be secured directly to the core 28-5 of the platen 28. By this construction, the stabilizer means 58 offsets the tilting of the platen 28 mentioned and enables the printing surface 28-3 of the platen 28 to remain in parallel relationship with the print face 24-2 of the print head 24.

Figure 2:
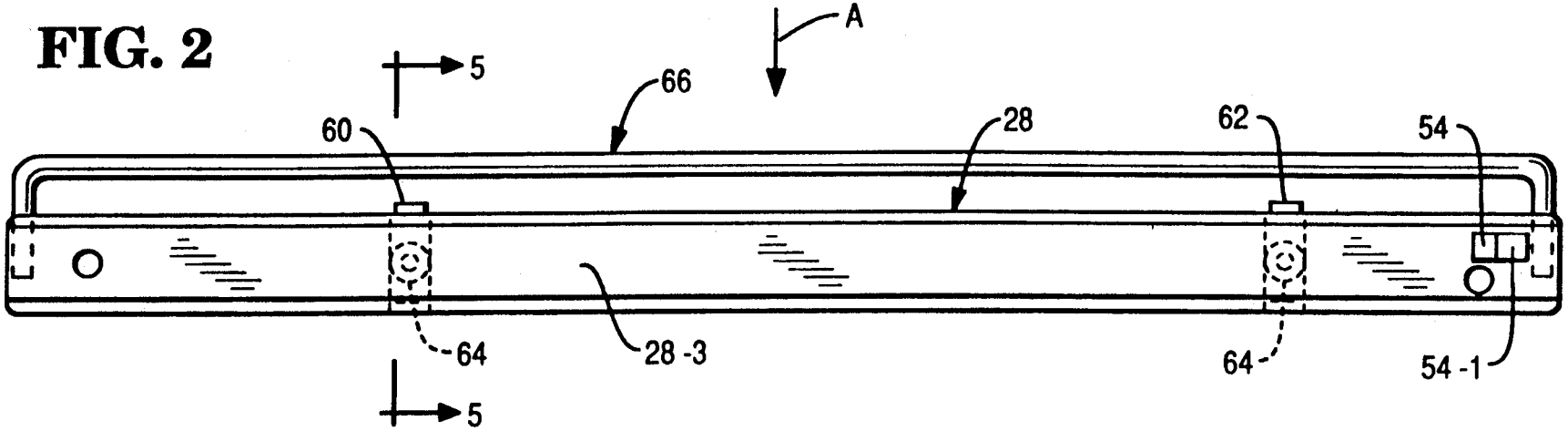
FIG. 2 is a plan view of a platen included in the apparatus shown in FIG. 1.

A discussion of some miscellaneous points relative to the printer 10 will follow. The printer 10 also includes a bail member 66 (FIGS. 2 and 3) which has the function of maintaining the length of the platen 28 parallel to the top surface 14-1 of the support means 14 as the platen 28 is lowered and raised as previously explained. Because a description of the bail member 66 and its functioning is not important to an understanding of this invention, no further details need be given. Additional details about the bail member 66 may be had by reference to U. S. Pat. No. 4,957,382 which is assigned to the same assignee as is this application. The carriage 26 is supported on a rod 68 and a traversing screw 70 (FIG. 4) supported in the printer 10 to enable the carriage 26 to move along the length of the platen 28.

While the apparatus 12 is discussed in relation to a wire matrix print head 24, it is apparent that the principles of this invention may be used with other printers, like a thermal print head, for example.

What is claimed is:

1. An apparatus comprising: a print head having a printing face and an associated forms compensation member; and a floating platen comprising:

a channel having first and second side walls and a bottom;

a platen having a printing surface, with said platen located in said channel;

resilient means biasing the platen away from the bottom of the channel towards said forms compensation member; and a stabilizer means secured to said platen and cooperating with one of said first and second side walls to maintain said printing surface in parallel relationship with said printing face.

2. The apparatus as claimed in claim 1 in which there is a tilting moment generated between said compensation member and said platen which causes said printing surface to tilt with respect to said printing face and in which said stabilizer means offsets said tilting moment.

3. The apparatus as claimed in claim 2 in which said compensation member is located closer to said second side wall than to said first side wall and in which said stabilizer means cooperates with said second side wall.

4. The apparatus as claimed in claim 3 in which said stabilizer means is of leaf-spring construction.

5. The apparatus as claimed in claim 3 in which said stabilizer means includes first and second leaf springs which are spaced apart along said platen, with each one of said first and second leaf springs having a first end and a second end, with said first ends secured to said platen, and with said second ends contacting said second side wall.

6. The apparatus as claimed in claim 5 in which said print head is a wire matrix printer.

7. A platen for use with an apparatus having:

a print head having a printing face and an associated forms compensation member; and a channel having first and second side walls and a bottom;

said platen being quadrilaterally-shaped in cross section and comprising:

a printing surface, an opposed bottom surface, and first and second side surfaces resilient means located on said bottom surface for urging said platen towards said print head when said platen is installed in said channel; and first and second leaf springs which are spaced apart along said platen, with each one of said first and second leaf springs having a first end and a second end, with said first ends secured to said platen, and with said second ends contacting said second side wall when said platen is installed in said channel.

8. The platen as claimed in claim 7 in which said first and second leaf springs are made of a copper beryllium alloy.

* * * * *